US005688073A

United States Patent [19]

Brodeur et al.

[11] Patent Number: 5,688,073

[45] Date of Patent: Nov. 18, 1997

[54] EARTH DRAINS

[76] Inventors: Joseph Clement Brodeur, Kendal Post Office, Kendal, Ontario, Canada, L0A 1E0; Vicko M. Von Stedingk, 26 Donino Avenue, Toronto, Ontario, Canada, M4N 2W5; Mark E. Siemonsen, 100 Rideau Street, Unit 102, Oshawa, Ontario, Canada, L1J 6P5

[21] Appl. No.: 568,838

[22] PCT Filed: May 18, 1994

[86] PCT No.: PCT/CA94/00281

§ 371 Date: Dec. 7, 1995

§ 102(e) Date: Dec. 7, 1995

[87] PCT Pub. No.: WO94/29530

PCT Pub. Date: Dec. 22, 1994

[30] Foreign Application Priority Data

Jun. 11, 1993 [CA] Canada ..... 2098263

[51] Int. Cl.[6] ..... E02B 11/00

[52] U.S. Cl. ..... 405/45; 405/43; 405/36; 405/50; 52/169.5

[58] Field of Search ..... 405/43, 36, 44, 405/45, 15, 47, 16, 258, 50; 52/169.5

[56] References Cited

U.S. PATENT DOCUMENTS

| | | | |
|---|---|---|---|
| 3,888,087 | 6/1975 | Bergsland | 61/11 |
| 4,622,138 | 11/1986 | Wager | 210/170 |
| 4,733,989 | 3/1988 | Harriett | 405/43 |
| 4,840,515 | 6/1989 | Freese | 405/43 X |
| 4,925,342 | 5/1990 | Hendy | 52/169.5 X |
| 4,943,185 | 7/1990 | McGuckin et al. | 52/169.5 X |
| 4,956,951 | 9/1990 | Kannakeril | 52/169.5 |
| 5,383,314 | 1/1995 | Rothberg | 405/43 X |

FOREIGN PATENT DOCUMENTS

| | | | |
|---|---|---|---|
| 1015173 | 3/1977 | Canada | 61/32 |
| 1073227 | 3/1980 | Canada | 61/32 |
| 1230980 | 1/1988 | Canada | 61/32 |
| 1309260 | 10/1992 | Canada | 61/32 |

OTHER PUBLICATIONS (PCT Int'l Pub. No. WO,A 83/02790 (Gemmell).
(PCT Int'l Pub. No. WO,A 82/03099 (Bergsland).

*Primary Examiner*—Tamara L. Graysay
*Assistant Examiner*—Frederick Lagman
*Attorney, Agent, or Firm*—Owen, Wickersham & Erickson, P.C.

[57] ABSTRACT

An earth drain comprising a core consisting of an elongated flexible web having on at least one surface thereof, and preferably on both surfaces, an array of discreet projections spaced transversely across the width of the web, and longitudinally in the lengthwise orientation of the web. The array of projections is interrupted by a plurality of elongated projection-free zones extending in the longitudinal direction of the web, and spaced transversely across the width of the web. A filter of sheet-like water permeable material encases the core, and is adapted to be maintained in spaced relationship to the web by the free ends of the projections thereon.

11 Claims, 2 Drawing Sheets

EARTH DRAINS

This application is a national stage application of international application number PCT/CA94/00281 filed May 18, 1994, now abandoned.

The present invention relates to earth drains for the drainage of soil having low water permeability such, for example, as clay.

More specifically, the type of earth drain to which this invention relates consists of a core comprising a relatively flat, flexible, elongated web having surface projections, usually on both sides thereof, which core is encased in a filter of water permeable sheet-like material. The projections on the web surfaces of the core serve to maintain the filter in spaced relationship with the web. Such drains are usually driven vertically into the ground to a substantial depth. In use, water passes through the free surface area of the filter i.e., that area of the filter which is not in contact with the web projections, and drains away through the space between the web surface and the encasing filter material. Drains of this type are illustrated in Oleg Wager Canadian patent No. 930,999 dated Jul. 31, 1973, and Oleg Wager Canadian patent No. 1,015,173 dated Aug. 9, 1977.

The drain described in Canadian patent No. 1,015,173 constituted an improvement of the drain described in the earlier Canadian patent No. 930,999. The drain disclosed herein constitutes an improvement on the drain described in Canadian patent No. 1,015,173, in that the drain of the present invention can be produced much more economically as a result of substantial savings in raw material costs and improved production efficiency while maintaining the satisfactory performance of the earlier drain.

In a broad aspect, the earth drain according to the present invention comprises a core consisting of an elongated flexible web having on at least one surface thereof, and preferably on both surfaces, an array of discreet projections spaced transversely across the width of the web, and longitudinally in the lengthwise orientation of the web. The array of projections is interrupted by a plurality of elongated projection free zones extending in the longitudinal direction of the web, and spaced transversely across the width of the web. A filter of sheet-like water permeable material encases the core, and is adapted to be maintained in spaced relationship to the web by the free ends of the projections thereon.

The web is typically of uniform width and indeterminate length, and the projections are preferably of uniform length or height (as measured from the surface of the web) and of uniform shape. Typically, the projections will be of frustoconical shape. However, the projections can be of cylindrical configuration or may have a circular, square, hexagonal, or other cross-section.

Preferably, the projection free zones will have a transverse width equal to or greater than twice the transverse spacing of adjacent longitudinal rows of projections. The projection free zone will be separated by at least two longitudinal rows of projections. Projections in adjacent rows, when viewed in either the longitudinal or transverse direction of the web will preferably be staggered by one half the spacing between adjacent projections to reduce the distance between unsupported areas of the filter in the projection covered areas of the web.

While the elongated projection free zones of the web may extend throughout the length of the web, preferably such zones will be interrupted at regular intervals in the longitudinal direction of the web by bands of transverse rows of projections which extend, with or without interruption, completely across the width of the web. The purpose of these transverse bands is to provide for a cross-flow of water flowing through the drain in the event of transverse blockage of the drain in those projection free zones in which the filter is unsupported by the tops of project ions.

The elongated projection free zones may be longitudinally aligned throughout the length of the web. Alternatively, the transverse spacing of the elongated projection free zones on opposite sides of each transverse band of projections may be staggered so that a projection free zone on one side of the band will be longitudinally opposite an array of projections on the opposite side of the band.

In drawings, which illustrate embodiments of the invention:

Figure 1:
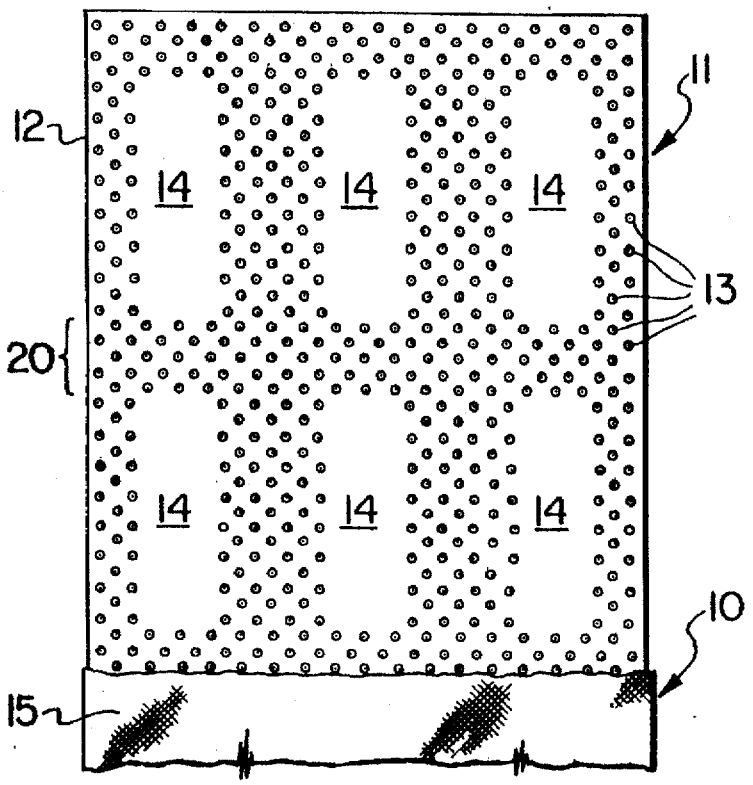
FIG. 1 is a schematic plan view, partially broken away, of an end segment of an embodiment of the drain according to the invention.
Figure 2:
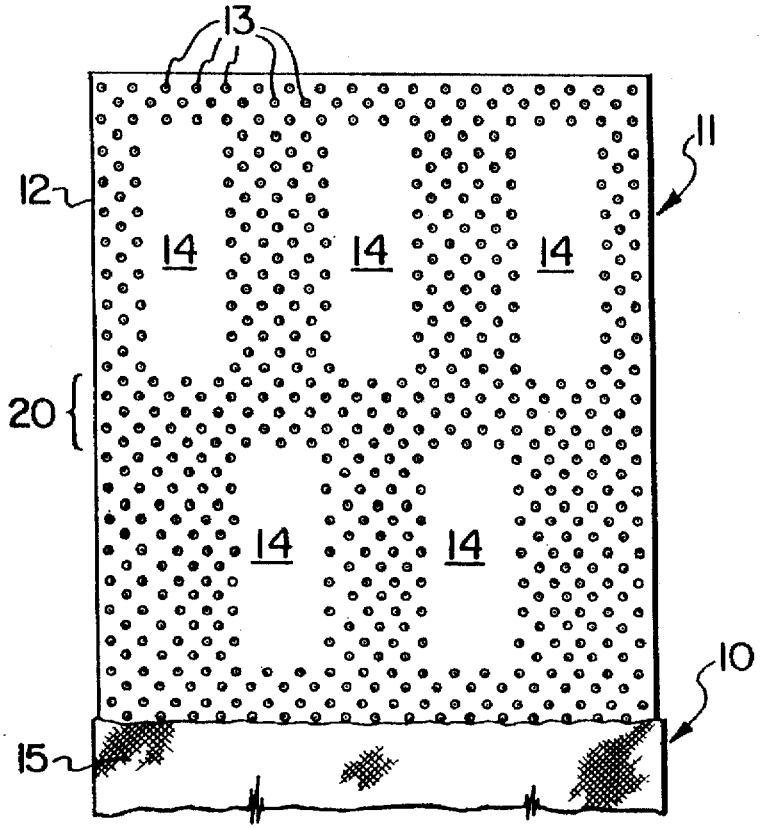
FIG. 2 is a schematic plan view similar to FIG. 1 of a second embodiment of a drain in accordance with the invention.

Referring now to FIGS. 1 and 2, the drain illustrated generally at 10 comprises a core 11 which consists of a generally flat, flexible web 12 and an array of discreet projections 13. As will appear from FIG. 4, the projections are disposed on both sides of the web 12, and the complete core is encased in a sheet-like filter 15 which is supported in spaced relationship to the web by the free ends of the projections 13. The filter is composed of a suitable water permeable material, whereas the core and projections are composed of water impermeable material. Accordingly, when the drain is inserted in the soil, water may pass through the filter (which prevents the ingress of soil particles) into the space between the filter and the web so that water may flow through the drain in the space between the filter and the web.

It will be seen that the projections 13 are regularly spaced in both the transverse and longitudinal directions of the web to form transverse and longitudinal rows. Adjacent rows, when viewed in either the transverse or longitudinal direction are staggered with respect to each other in a sense that the projections in one row are displaced one half the distance between the projections in the adjacent row in order to minimize the unsupported area of the filter in the projection covered areas of the web.

According to the present invention, the array of projections 13 on the web is interrupted by a plurality of elongated projection free zones 14 extending in the longitudinal direction of the web, and spaced transversely across the web. These projection free zones permit free uninterrupted flow of water along the drain under normal operating conditions and, of course, the provision of the projection free zones greatly reduces the number of projections on the web, and, consequently, greatly reduces the cost of raw materials required to form the core, and the weight of a unit length of the drain.

The projection free zones typically will be equivalent in width to two or three times the transverse spacing of adjacent longitudinal rows of projections. The length of the projection free zones is not particularly critical. Indeed, the projection free zones can extend for the entire length of the web, although, typically, they will be interrupted by transverse bands 20 of projections which extend completely across the width of the web to interrupt the elongated projection free zones at regular intervals along the length of the web. In a typical drain this will result in a plurality of elongated projection free zones in alignment throughout the length of the drain and spaced transversely across the drain. However, as illustrated in FIG. 2, the elongated projection free zones on either side of a transverse band of projections 20 may be staggered or displaced laterally one half the transverse distance between laterally adjacent projection free zones 14 to result in a staggered arrangement along the length of the drain. It is also possible that the bands 20 will be discontinuous in the sense that they will interrupt the projection free zones across the web at different longitudinal locations, while still providing for cross-flow over the entire width of the web.

Figure 3:
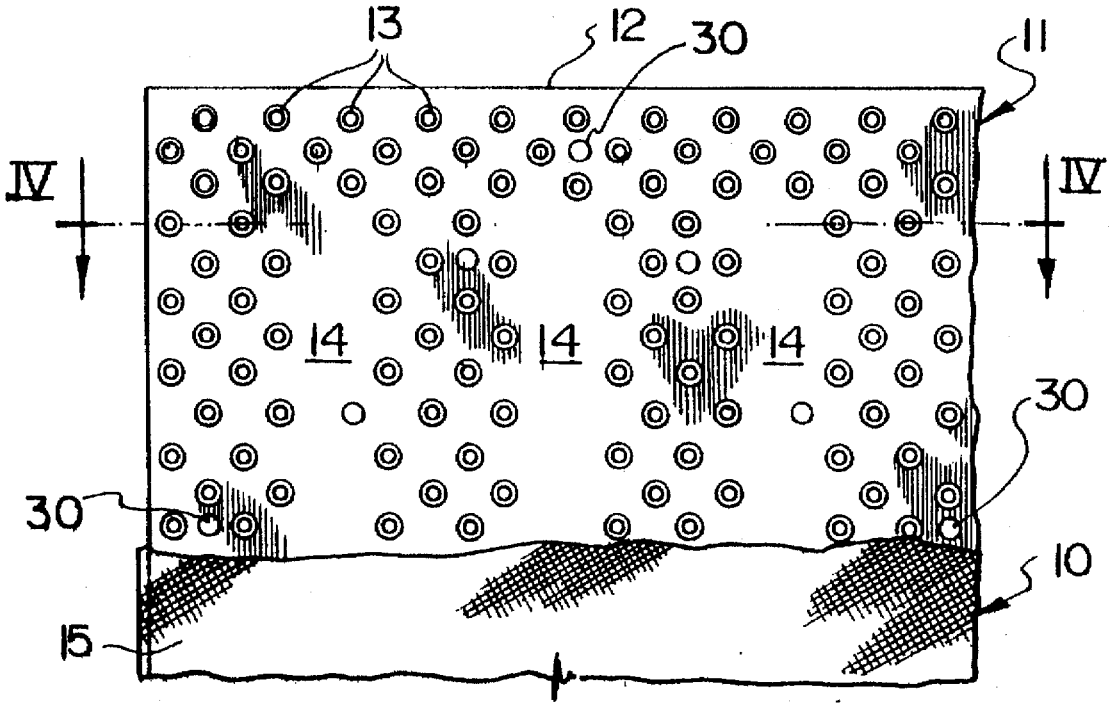
FIG. 3 is a plan view, partially broken away, on an enlarged scale of the drain of FIG. 1.
Figure 4:
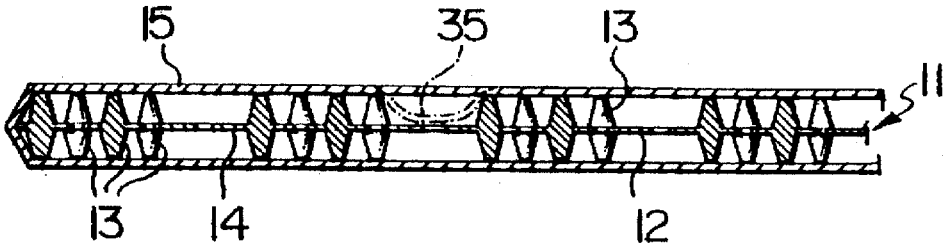
FIG. 4 is a fragmentary cross-section of the drain depicted in FIG. 3 through the line IV—IV, but including the filter.

A segment of a typical drain is illustrated in greater detail in FIGS. 3 and 4. Referring particularly to FIG. 4, it will be seen that the projections are frusto-conical in shape, with the larger base adjoining the web 12, and the smaller free end supporting the filter 15. Further, it will be seen that the web is provided with a number of apertures 30 extending therethrough which permit the passage of water from one side of the web to the other. This, in conjunction with the transverse bands of projections 20, which provide cross-flow zones at regular longitudinal intervals along the web facilitates the unimpeded flow of water through the drain even in the event of local blockage.

Local blockage may occur, particularly in the projection free zones, as a result of lateral soil pressures which force the filter inwardly into contact with the web. Such deformation of the web is illustrated schematically by dotted lines 35 in FIG. 4 when such deformation occurs, the passage of water along the drain in the area of the local blockage will be impeded. However, a relatively free flow of water and steady volume of water flow along the drain is assured because the water, in the area of the blockage, may circumvent the blockage by flowing laterally into the adjoining projection covered zones, and thereafter in the longitudinal direction of the drain. Additionally, water above the blockage may flow through apertures 30 from one surface of the drain to the other, as it is highly unlikely that both surfaces would be blocked in the same area and on opposite sides of the drain. However, even if this should occur, the projection covered zones of the web on either side of each projection free zone assures both lateral and longitudinal flow of water.

Figure 5:
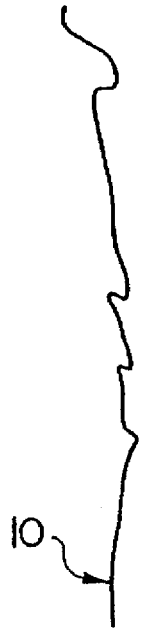
FIG. 5 is a schematic side elevation of a distorted drain in actual use.

Similarly, as a result of unstable soil conditions, earth drains of the type to which this invention relates are subject to deformation which is illustrated in FIG. 5. As a result of the subterranean shifting of soil for various reasons, drains which were originally substantially straight when installed, may be subject to severe deformations (micro folding) which, in some known drain designs would result in complete blockage of water flow in the longitudinal direction of the drain. However, as a result of the longitudinally continuous array of projections and the bands 20, providing cross-flow zones, the drain of the subject invention will remain unblocked even under severe micro folding such as that depicted in FIG. 5. In other words, the projections will always maintain a spacing between the filter and the web to permit the flow of water there along, and the cross-flow zones 20 will always permit redistribution of flow transversely across the drain in the event of blockage in certain local zones, such as the projection free zones.

Typically the projection free zones will be spaced apart by at least two longitudinal rows of projections, although a somewhat greater spacing may be desirable. The exact spacing, as well as the longitudinal spacing of the cross-flow bands 20 may be selected depending upon the drainage requirements, the nature of the soil being drained.

Similarly, the length of the projections may vary depending upon the drainage requirements, and the spacing of the projections may also be varied depending upon the nature of the filter material being used, and other conditions such as those Just mentioned. The standard core width of drains of this type is 100 mm, and, by way of example the length of the projection may be 1.25 mm.

While a particular embodiment of the drain has been illustrated by way of example, it will be appreciated that many modifications are possible without departing from the scope of the invention. For example, while frusto-conical shaped projections have been illustrated, the projections could be cylindrical and/or of cross-section other than circular, for example, square, hexagonal, oval, or the like. While it is obviously preferable to have all projections in a single drain of uniform shape and height, there is no reason why different shapes and heights could not be utilized, for example, in adjacent longitudinal 0F transverse rows. Further, as noted previously, the particular spacing and height of the projections, the number and width of the projection free zones, and the width of the projection covered zones between the projection free zones may be varied depending upon the specific conditions and drainage requirements in a particular area.

Compared with the known drain described in Canadian patent No. 1,015,173, the costs of manufacturing the drain of the subject application are appreciably less. The provision of the projection free zones constitutes a considerable reduction in raw material costs and the reduced net volume of projections results in a shallower draw for the plastic resin during the core forming process. This will relax raw material specifications, as the drain will be easier to manufacture, thus permitting a much wider selection of resins from which to choose, including reprocessed or recycled materials which, again, will result in a significant reduction in raw material costs and benefits-to the environment.

We claim:

1. An earth drain comprising a core consisting of an elongated flexible web having on at least one surface thereof an array of spaced projections, each having a base end affixed to said web, and a free end spaced from said web, the projections of said array being evenly spaced in parallel rows extending longitudinally and transversely of said web and a filter of sheet-like water permeable material encasing said at least one surface and adapted to be maintained in spaced relationship to said web by the free ends of said projections, characterized in that said array of projections is interrupted by a plurality of transversely spaced elongated projection free zones extending longitudinally of said web, the dimensions of said projection free zones in the transverse and longitudinal directions of the web being greater than the spacing between adjacent projections.

2. An earth drain as defined in claim 1, wherein said web is of uniform width, and array of projections is disposed on each surface thereof and said filter encases said core.

3. An earth drain as defined in claim 2, wherein said projection free zones extend the length of said core.

4. An earth drain as defined in claim 3, wherein said projection free zones are spaced at regular intervals transversely of said web, and adjacent projection free zones are spaced apart by at least two longitudinally extending rows of projections.

5. An earth drain as defined in claim 2, wherein said projection free zones are spaced at regular intervals transversely of said web and are longitudinally interrupted by transverse bands comprising at least one transversely extending row of projections.

6. An earth drain as claimed in claim 5, wherein said transverse bands extend without interruption across the width of the web.

7. An earth drain as defined in claim 6, wherein said transverse bands comprise at least two transversely extending rows of projections.

8. An earth drain as defined in claim 6, wherein the elongated projection free zones on one side of each band are laterally displaced one half the distance of the transverse spacing between the elongated projection free zones on the other side of the band to produce a staggered arrangement of said projection free zones throughout the length of the web.

9. An earth drain as defined in any of claims 1, 2, 3, 4, 5, 7, 8 or 6, wherein the projections in adjacent longitudinally and transversely extending rows are displaced a distance equal to one half the spacing between adjacent projections in a row, whereby rows of said projections in the longitudinal and transverse directions are staggered with respect to adjacent rows.

10. An earth drain as defined in claim 9, wherein the width of said projection free zones is equal to three times the transverse spacing of adjacent longitudinal rows of projections.

11. An earth drain as defined in claims 1, 2, 3, 4, 5, 7, 8 or 6 wherein said projections are of frusto-conical configuration.

* * * * *